US005133399A

United States Patent [19]

Hiller et al.

[11] Patent Number: 5,133,399

[45] Date of Patent: Jul. 28, 1992

[54] APPARATUS BY WHICH HORIZONTAL AND VERTICAL BLINDS, PLEATED SHADES, DRAPES AND THE LIKE MAY BE BALANCED FOR "NO LOAD" OPERATION

[76] Inventors: Jeffrey H. Hiller; Stephen S. Hiller, both of 3000 Sand Hill/Park Rd., Menlo Park, Calif. 94025

[21] Appl. No.: 628,742

[22] Filed: Dec. 17, 1990

[51] Int. Cl.[5] ..... E06B 9/30

[52] U.S. Cl. ..... 160/171; 160/170

[58] Field of Search ..... 160/170, 171, 168.1

[56] References Cited

U.S. PATENT DOCUMENTS

| | | | |
|---|---|---|---|
| 13,251 | 7/1855 | Bixler | 160/170 |
| 2,420,301 | 5/1947 | Cusumano | 160/170 |
| 3,799,236 | 3/1974 | Debs | 160/178.2 |
| 4,177,853 | 12/1979 | Anderson | 160/168.1 |
| 4,200,135 | 4/1980 | Hannequin | 160/168.1 |
| 4,327,797 | 5/1982 | Nakajima | 160/168.1 |
| 4,377,194 | 3/1983 | Tsuhako | 160/168.1 |
| 4,441,540 | 4/1984 | Tsuhako | 160/168.1 |
| 4,456,049 | 6/1984 | Vecchiarelli | 160/176.1 |
| 4,487,243 | 12/1984 | Debs | 160/168.1 |
| 4,531,563 | 6/1985 | Nilsson | 160/168.1 |
| 4,550,759 | 11/1985 | Archer | 160/176.1 |
| 4,567,930 | 2/1986 | Fischer | 160/166.1 |
| 4,572,267 | 2/1986 | Stein | 160/176.1 |
| 4,593,738 | 6/1986 | Chi Yu | 160/176.1 |
| 4,621,673 | 11/1986 | Georgopoulos | 160/168.1 |
| 4,628,979 | 12/1986 | Hsu | 160/115 |
| 4,643,238 | 2/1987 | Tachikawa | 160/168.1 |
| 4,673,018 | 6/1987 | Judkins | 160/84.1 |
| 4,676,292 | 6/1987 | Valle | 160/176.1 |
| 4,687,041 | 8/1987 | Anderson | 160/168.1 |
| 4,697,630 | 10/1987 | Rude | 160/177 |
| 4,699,196 | 10/1987 | Elliott | 160/168.1 |
| 4,708,188 | 11/1987 | Bytheway | 160/174 |
| 4,719,955 | 1/1988 | Tachikawa | 160/168.1 |
| 4,722,383 | 2/1988 | Kross | 160/178.2 |
| 4,727,921 | 3/1988 | Vecchiarelli | 160/168.1 |
| 4,762,161 | 8/1988 | Anderson | 160/178.2 |
| 4,799,526 | 1/1989 | Reeves | 160/168.1 |
| 4,821,789 | 4/1989 | Van Rens | 160/176.1 |
| 4,850,416 | 7/1989 | Evers | 160/188 |
| 4,856,574 | 8/1989 | Minami | 160/168.1 |
| 4,869,308 | 9/1989 | Chang | 160/176.1 |
| 4,875,516 | 10/1989 | Marocco | 160/178.1 |
| 4,886,102 | 12/1989 | Debs | 160/177 |

*Primary Examiner*—Blair M. Johnson

*Attorney, Agent, or Firm*—Townsend and Townsend

[57] ABSTRACT

An improved blind unit or shade having no pull cord for raising and lowering the blind members of the blind unit. The lower rail is movable upwardly from the lowermost position thereof when an upwardly directed force is applied to cord structure coupled with the blind members and the lower rail. When the lower rail moves progressively upwardly or downwardly with reference to the head rail above the blind members, the lower rail supports a progressively greater or lesser number of blind members. A variable, upwardly directed force is applied to the cord structure with the force being substantially equivalent at all times to the combined weights of the lower rail and the blind members supported on the lower rail when the lower rail is above its lowermost operative position. The force applying means, in one embodiment includes at least one conical member coupled to a constant force spring. In another embodiment, the force applying means includes a variable force leaf spring.

24 Claims, 3 Drawing Sheets

FIG.4
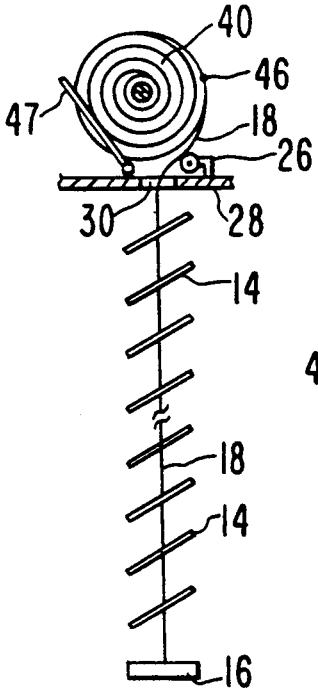
FIG.4A
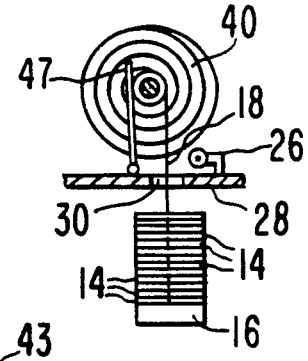
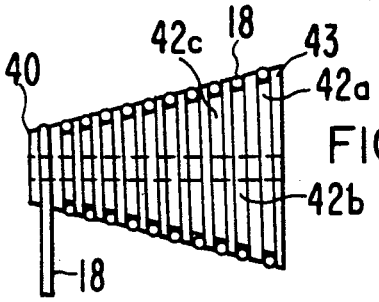
FIG.5B
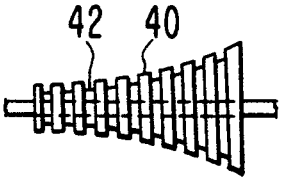
FIG.5
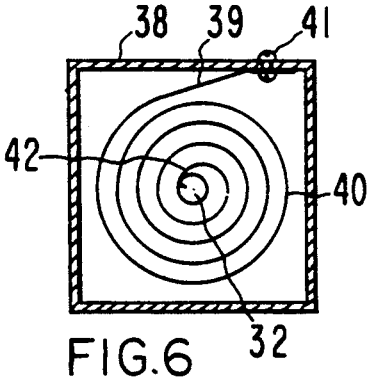
FIG.6
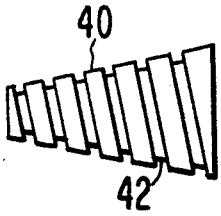
FIG.5A
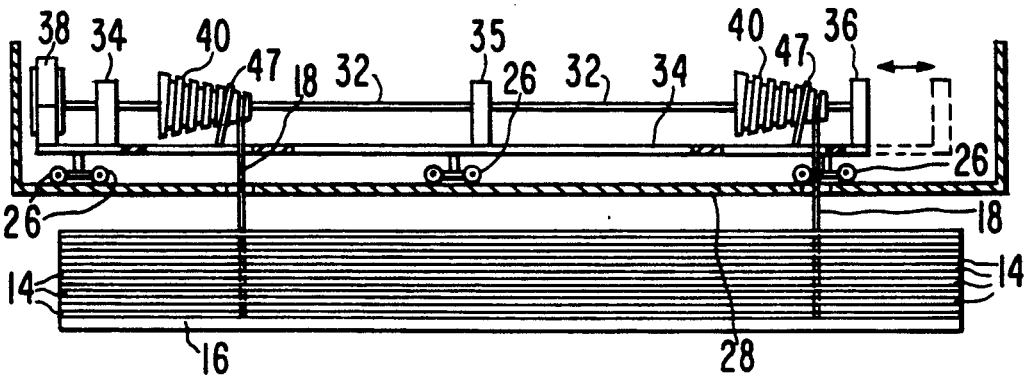
FIG.7

APPARATUS BY WHICH HORIZONTAL AND VERTICAL BLINDS, PLEATED SHADES, DRAPES AND THE LIKE MAY BE BALANCED FOR "NO LOAD" OPERATION

This invention relates to apparatus by which blind, drapery, shade units and the like may be operated. This apparatus provides for no pull cord for raising and lowering horizontal blinds, or opening or closing vertical blinds, pleated shades and drapery units.

BACKGROUND OF THE INVENTION

Blind, shade or drapery units typically have a head rail and a plurality of slats, blind members, or pleated fabric which are controlled by cords, whereby a pull cord coupled to the slats, blind members, fabric or operator can be pulled downwardly to raise or open the window covering. The pull cord is allowed to be moved upwardly to lower the blind or close the window covering. As size increases, there is an obvious change in the weight. Thus, greater force is necessary to open and close a particular unit.

Pull cords are often hazardous in use because they are of relatively long lengths so that they may accumulate on an adjacent floor in a pile of cord strands. A hazard is presented because persons, especially children, walking in the vicinity of the piled strands might inadvertently become entangled in the cords, resulting in sever or fatal injury.

Pull cords, due to continual use, are subject to becoming frayed and dirty and require replacement. The task of replacement requires disassembly of certain parts in the head rail, and this is not only costly and time consuming but also is inconvenient.

Because of the problems and drawbacks associated with conventional blind units, improvements in such blind units to eliminate pull cords, i.e., balance the load, are needed and such a need is filled by providing the improved blind unit of the present invention.

SUMMARY OF THE INVENTION

For sake of demonstration, the present invention is featured in a horizontal blind unit using a movable carriage. It is to be understood that the invention is not limited to this type of blind unit nor specific carriage means. The invention may be adapted to horizontal and vertical blinds, pleated shades, drapes and the like.

The improved "no-load" blind unit of the present invention needs no pull cord for raising and lowering the blinds or blind members of the blind unit. (Not shown is how the slats may be tilted. This may be accomplished either by a rotating wand, short or continuous cords, or the like.) Instead, the lower rail of the blind unit is movable upwardly from the lowermost position thereof when an upwardly directed force is applied to the lower rail. When the lower rail moves progressively upwardly or downwardly with reference to the head rail above the blind members, the lower rail supports a progressively greater or lesser number of blind members. At its lowermost position, the lower rail does not support any of the blind members, and the upward force exerted on the cord structure is at a minimum.

Structure is provided for applying an upwardly directed force to the cord structure with the force being substantially equivalent at all times to the combined weights on the cord structure. Such combined weights are the weights of the lower rail and the blind members supported on the lower rail when the lower rail is above its lowermost operative position. Thus, the lower rail and the blind members can e raised or lowered by manually moving the lower rail upwardly or downwardly with a minimum of force applied by the hand to the lower rail. This can be done without a handle on the lower rail. This feature thus eliminates the pull cord of conventional blind units and thereby eliminates the hazards associated with such pull cords.

An object of the present invention is to provide an improved no-load blind unit which can be operated with substantially no manual force applied to a lower rail of the blind unit to thereby eliminate the need for conventional pull cords while permitting the blind members to stop at any location along their vertical path of travel yet only a minimum force is required to move the blind members upwardly or downwardly at any time.

Other objects of the present invention will become apparent as the following specification progresses, reference being had to the accompanying drawings for an illustration of one example of the invention.

BRIEF DESCRIPTION OF THE DRAWINGS

FIG. 4 is a fragmentary, end elevational view of the blind unit of FIG. 1, showing a cord coupling the lower rail to a conical force-applying member carried in the head rail and coupled to a rotatable shaft;

FIG. 4A is a view similar to FIG. 4 but showing the position of the cord on the conical member when the lower rail and the blind members are in their uppermost positions adjacent to the head rail;

FIGS. 5, 5A and 5B are side elevational views of several different embodiments of the conical member of the present invention;

FIG. 6 is an enlarged cross sectional view of a spring housing showing a coil spring in the housing and coupled to a rotatable shaft;

FIG. 7 is a view similar to FIG. 1 but showing the lower rail and the blind members in their highest positions adjacent to and beneath the head rail;

DETAILED DESCRIPTION OF THE DRAWINGS

Figure 1:
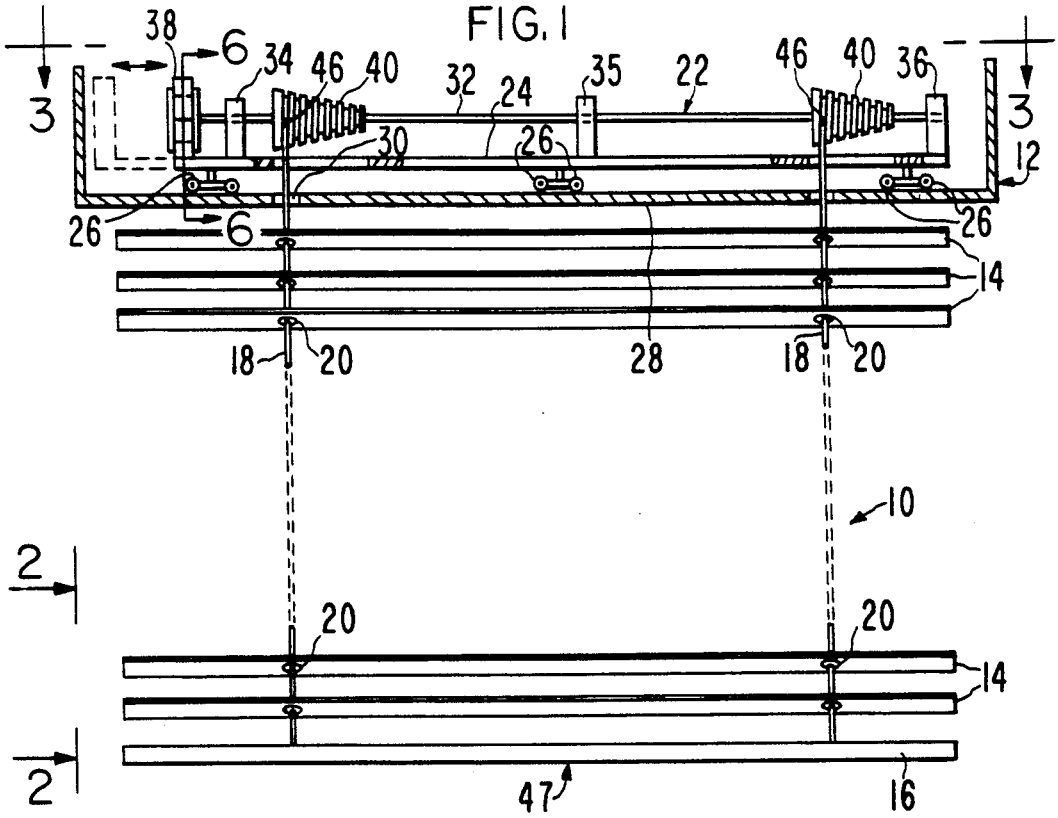
FIG. 1 is a side elevational view, partly in section, of the blind unit of the present invention, showing the blind members and lower rail in normal operative positions below a head rail with the force applying means of the invention in the head rail.

The example blind unit of the present invention is broadly denoted by the numeral 10 and includes a hollow, open top head rail 12, a plurality of vertically spaced, slats, blinds or blind members 14 and a lower rail 16 beneath the blind members 14. A pair of spaced, vertical cords 18 extend through respective holes 20 in blind members 14, and the lower ends of the cords 18 are secured in any suitable manner to lower rail 16 at locations thereon as shown in FIG. 1. The upper ends of the cords 18 are coupled to force-applying means 22 hereinafter described. Means (not shown) of conventional construction can be provided to vary the angle of inclination of the blind members 14 so that the spaces between the blind members can be varied to allow more light through the blind unit or less light through the blind unit.

Figure 3:
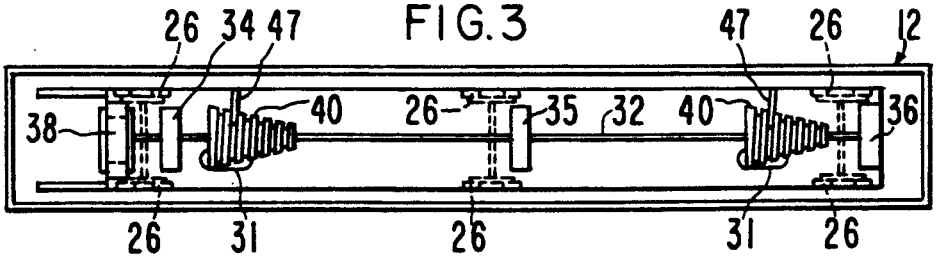
FIG. 3 is a top plan view of the head rail, looking in the direction of line 3—3 of FIG. 1.

The force-applying means 22 includes a movable support plate 24 having wheels 26 at each of a number of spaced locations on the bottom surface of support plate 24. The wheels 26 are in rolling engagement with the upper surface of the bottom 28 of head rail 12. Bottom 28 has slots 30 which allow cords 18 to pass through bottom 28 and into head rail 12 as shown in FIG. 1. Also, plate 24 has cord-receiving slots 31 (FIG. 3) to allow movement of plate 24 relative to cords 18 when the cords wind onto and unwind from conical members 40 to be described.

A shaft 32 is mounted on support plate 24 by spaced bearings 34, 35 and 36 so that the shaft can rotate in opposite directions relative to the head rail.

A spring housing 38 containing a constant force coil spring 44 (FIG. 6) is mounted on support plate 24 adjacent to bearing 34. The adjacent end of shaft 32 extends into housing 38 and is secured in any suitable manner to the inner end 45 of spring 44. Thus, spring 44 exerts a constant tangential force on shaft 32, tending to rotate the shaft in a counterclockwise sense when looking in the direction of lines 6—6 of FIG. 1. The outer end of spring 44 is coupled by a fastener 41 to housing 38 in any suitable manner.

A pair of conical members 40 are mounted on shaft 32 for rotation therewith. Members 40 are adjacent to respective bearings 34 and 36 and each conical member has means thereon for forming a spiral groove 42 (FIG. 5B), the convolutions of the spiral groove being denoted by the numerals 42*a*, 42*b*, 42*c* and so on. Any suitable means may be provided for forming the spiral groove 42, such as an etched outer surface or a spiral cord-like member 43 wrapped around the outer surface of the conical member 40. FIG. 5B shows a cord 18 in the adjacent convolutions 42*a*, 42*b*, 42*c* and so forth. The cord can be wound into the groove to form the convolutions of the cord when shaft 32 rotates in a counterclockwise sense when viewing left to right in FIG. 1.

The upper ends of cords 18 are secured, such as by a fastener 46 (FIGS. 1 and 4) to the outer surfaces of the corresponding conical members 40 near the large diameter ends thereof. Fasteners 46 are coupled to respective conical members 40 when lower rail 16 is in its lowermost position shown in FIG. 1. This connection can also be made before cords 18 are wrapped on respective conical members 40 and the blind members 14 are in their lowermost operative positions.

Since the constant force of spring 44 biases shaft 32 in a counterclockwise sense when viewing from left to right in FIG. 1, the conical members 40 will exert a minimum upward tangential force on cords 18 with the cords being under a tension equal to the upward force exerted by the conical members so as to suspend and support the lower rail 16. Thus, the tangential force exerted on each cord 18 by the respective conical member 40 will be of minimum magnitude because the force will be applied at the maximum outer diameter end of the respective conical member 40. This force of minimum magnitude exerted by each conical member 40, respectively, is equal to one-half the weight of the lower rail 16 with the total weight of the lower rail being equally distributed along the length of the lower rail 16. The conical members 40 are calibrated as to the constant force of spring 44 so that the conical members 40 will not rotate while they suspend the lower rail 16 in the manner shown in FIG. 1. The weight of the lower rail 16 is thus evenly divided between the two conical members 40.

When an upward manual force of minimal magnitude is applied at the center location 47 (FIG. 1) of lower rail 16, the cords 18 will tend to wrap around conical members 40, beginning at the large diameter end thereof. When this occurs, the force exerted by the conical members 40 on the cords 18 changes and increases in magnitude because the moment arm or distance from the tangent point at which the cords move onto the respective conical members 40 decreases so that, for a constant force exerted on the shaft 32 by constant force spring 44, this reduced lever arm or moment arm causes a larger upward force to be exerted on the cords 18. Thus, the lower rail 16 can support one or more of the blind members in the manner shown in FIG. 2A. The lower rail is thus movable upwardly from its lowermost operative position when an upward force is applied to the cords 18 by conical members 40.

The lower rail is operable to support a progressively greater or lesser number of blind members as the lower rail moves progressively upwardly or downwardly relative to the head rail. As the head rail continues to be pushed upwardly with minimum force such as at location 47 on the lower rail 16 as shown in FIG. 1, more and more blind members are supported and add to the weight of the lower rail as shown in FIG. 2A. This continues until the blind members 14 and the lower rail 16 are in the FIG. 4A positions thereof. At such time, the cords 18 are at the lower diameter ends of the respective conical members 14, and at these locations, the maximum upward force is applied to cords 18 to support all of the blind members 14 and the lower rail 16 when the members 14 and rail 16 are stacked as shown in FIG. 4A. The combination of elements including shaft 32, coil spring 44 and conical members 40 provide a means for applying a variable upwardly directed force to the cords 18 with the force being substantially equivalent to the combined weights of the lower rail and the blind members supported on the lower rail when the lower rail is above its normal, lowermost operative position.

Thus, the lower rail and the blind members can be raised or lowered by manually moving the lower rail upwardly or downwardly with a minimum of force applied to the lower rail.

To apply an upward force to the lower rail when the lower rail is in the position shown in FIG. 1, the hand is placed at or near location 47 and an upward push or a substantially no-load force is exerted on the lower rail 16 causing the lower rail to rise which, in turn, causes wrapping of the cords 18 on respective conical members 40. To apply a downward force to the lower rail from the position shown in FIG. 4A, the lower rail is grasped between the thumb and finger at a point near location 47 (FIG. 1) and pulled downwardly with minimum force at which time the shaft rotates in a clockwise sense when viewing from left to right in FIG. 1. As the blind members 14 and lower rail 16 move downwardly, their combined weights are counterbalanced by the bias force exerted on shaft 32 by spring 44. In this way, the blind unit 10 can be opened and closed by the movement of the hand upwardly and downwardly. This feature eliminates pull cords and other structure for raising and lowering the blinds.

Figure 2:
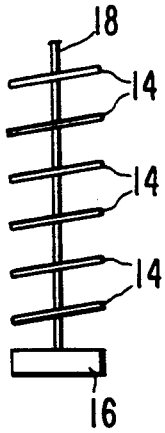
FIG. 2 is a fragmentary end elevational view of the blind members and the lower rail when the lower rail is in its lowermost position.
Figure 2A:
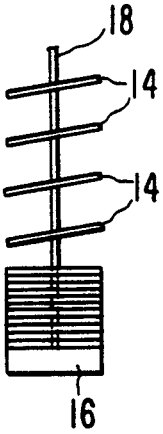
FIG. 2A is a view similar to FIG. 2 but showing the lower rail in an elevated position in supporting relationship to a number of the blind members.

FIGS. 5 and 5A show different embodiments of conical member 40 which can be calibrated to provide for the variable, upwardly directed force on the cord means 18 with the force being substantially equivalent to the combined weights of the lower rail and the blind members supported on the lower rail when the lower rail is above its operative position shown in FIGS. 1, 2 and 4. FIG. 5 shows that the outer conical surface of the conical member 40 is transversely curved. FIG. 5A shows that the convolutions of the groove in the outer surface of conical member 40 has an angle between adjacent convolutions which increases as the large diameter end of the conical member is approached. In either case of the conical members of FIGS. 5 and 5A, the conical members will be calibrated as to these parameters so as to provide the variable, upwardly directed force for each conical member 40 as described above.

An indexing pin 48 for each member 40, respectively, is pivotally mounted at one end thereof to movable support plate 24 of head rail 12 as shown in FIGS. 3, 4, 4A and 7. Pins 48 keep the cords 18 in the grooves 42 in the conical members 40.

While a pair of conical members 40 have been shown on shaft 32 for cords 18, it is possible to use only a single conical member 40 to cause raising and lowering of the blind members 14 and lower rail 16. In using a single conical member 40, idlers will be used to change the direction of the cords 18 so that the cords will be superimposed on each other as the cords are wrapped about or unwrapped from the spiral groove of the single conical member 40.

Another embodiment of the spring means of the present invention is broadly denoted by the numeral 60 and includes a leaf or deflection spring body 61 having a lower end coupled to the base or bottom 28 of head rail 12. The spring extends upwardly and has an unflexed condition as shown in dashed lines in FIG. 8. When flexed, the spring is in the full line position. Spring 60 provides a variable force which is exerted on cords 18 to counterbalance the weight of the blind members 14 supported on lower rail 16 when the lower rail is above its lowermost position.

An idler 62 is on the upper end of the spring 61, and the idler allows a cord 18 to pass over the top of spring 60 and then downwardly along the length thereof to a weight 64 which moves up and down along the length of the spring.

Figure 8:
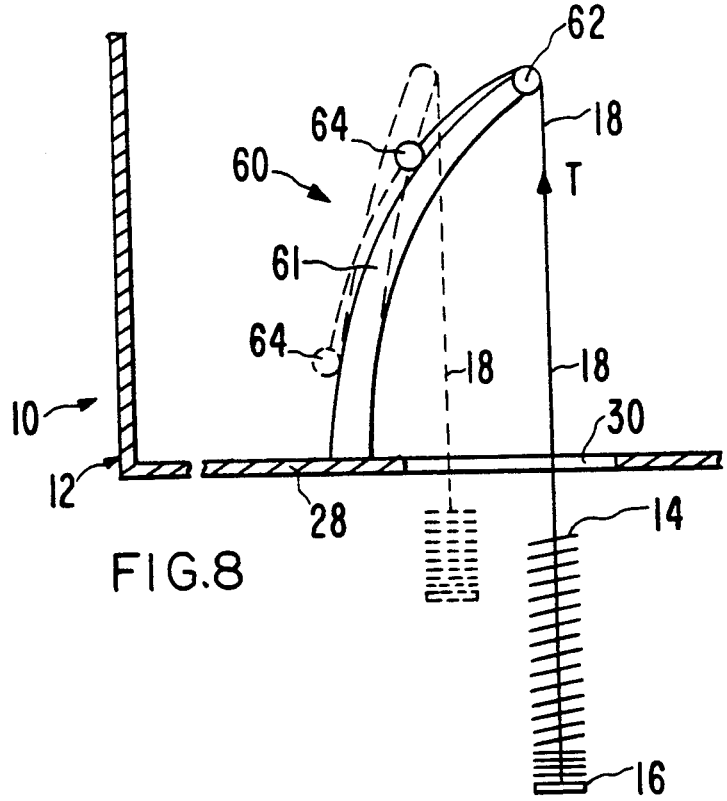
FIG. 8 is a schematic view of a leaf spring carried by the head rail of the blind unit of the present invention, showing a cord extending over the upper end of the spring and then downwardly to a weight which allows the spring to deflect from the dashed line position thereof to the full line position and return as a function of the raising and lowering of the lower rail.

When the weight 64 is in the full line position of FIG. 8, the spring is flexed into the full line position. When the weight 64 is in the lowered dashed line position of FIG. 8, the spring is unflexed. The full line position of weight 64 corresponds to the condition when some of the blind members 14 are in their operative positions while the other blind members are stacked on and be supported by the lower rail 16 as shown in FIG. 2A. The weight 64 in the dashed line position of FIG. 8 corresponds to the condition when all of the blind members 14 are stacked on the lower rail as shown in FIG. 4A. In any case, depending upon the position of the weight 64, spring 60 will exert an upward force or tension T on cord 18 and this force or tension will increase as a function of the movement of the weight 64 downwardly along the length of spring 60.

A disadvantage of using spring 60 is that it requires a relatively long length. Thus, the spring will generally project above the open top of the head rail and this feature may be objectionable from an aesthetic point of view.

Figure 9:
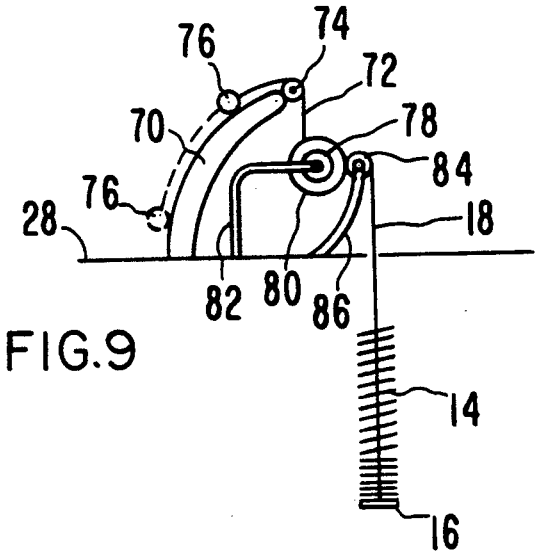
FIG. 9 is a view similar to FIG. 8 but showing a spring of shorter length than the spring of FIG. 8.

To overcome the problem of the relatively long length of the spring embodiment of FIG. 8, the variable force spring of the embodiment of FIG. 9 can be provided. Spring 70 of FIG. 9 is supported at the lower end on the upper surface of the bottom 28 of the head rail 12. A cord 72 is passed around an idler 74 to a weight 76 which moves up and down the length of spring 70. The spring is flexed to a greater or lesser degree depending upon whether the weight 76 is near the upper end of spring 70 or remote from the upper end such as in the dashed line position of FIG. 9.

The lower end of cord 72 is wrapped around a pulley 78 on a gear 80 secured by a support strut 82 to bottom 28 in any suitable manner. Gear 80 is coupled to a second spur gear 84 of smaller diameter than gear 80 and a cord 18 is wrapped around a pulley (not shown) on gear 84. Thus, the take up movement of cord 18 will result in a reduced rotation speed of pulley 78 which will provide a minimum movement of weight 76 for a maximum movement of cord 18. In this way, a variable force is exerted by spring 70 through gears 80 and 84 on cord 18 so that lower rail 16 can be easily grasped and raised and lowered while the variable is exerted on cord 18 by the spring through the gears.

We claim:

1. A blind unit comprising:

a head rail;

a plurality of blind members below the head rail;

a lower rail below the blind members, each blind member and the lower rail having a normally lowermost operative position;

cord means including a pair of spaced cords for suspending the lower rail below the head rail, said cords extending into the head rail, said lower rail being movable upwardly form said lowermost operative position thereof when an upward force is applied to the cords, said lower rail being operable to support a progressively greater or lesser number of blind members as the lower rail moves progressively upwardly or downwardly; and means for applying a variable, upwardly directed force to the cords with the force being substantially equivalent to the combined weights of the lower rail and the blind members supported on the lower rail when the lower rail is above its normal operative position, said applying means including a shaft, means mounting the shaft in said head rail for rotation about an axis, a constant force spring coupled to such shaft for biasing the shaft for rotation in one direction about said axis, and a conical member for each cord, respectively, said conical member being secured to the shaft, each cord being coupled to the respective member for coupling the cord to the shaft to permit the force on the cord to progressively increase as the lower rail progressively approaches the head rail and to permit the force on the cord to progressively decrease as the lower rail progressively moves away from the head rail, whereby the lower rail and the blind members can be raised or lowered by manually moving the lower rail upwardly or downwardly with a minimum of force applied to the lower rail.

2. A blind unit as set forth in claim 1, wherein each conical member has a spiral groove in the outer surface therein.

3. A blind unit as set forth in claim 1, wherein each conical member has a pair of opposed ends, each cord being coupled at the upper end thereof to the ned of the respective conical member of maximum diameter with the cord being unwound from the conical member when the lower rail is in its lowermost operative position.

4. A blind unit as set forth in claim 1, wherein cord is wound on the respective conical member and forms convolutions from the end of maximum diameter to the end of minimum diameter, the cord extending downwardly form the end of minimum diameter when the lower rail and the blind members are in their highest positions relative to the head rail.

5. A blind unit as set forth in claim 1, wherein the conical member has a transversely straight side wall.

6. A blind unit as set forth in claim 1, wherein each conical member has a transversely curved side wall.

7. A blind unit as set forth in claim 1, wherein each conical member has a spiral groove in the outer surface thereof, said groove having a series of generally parallel convolutions.

8. A blind unit as set forth in claim 1, wherein each conical member has a spiral groove in the outer surface thereof, said groove having a series of convolutions, the angle between adjacent convolutions increasing as one end of the conical member is approached.

9. A blind unit as set forth in claim 8, wherein the angle between adjacent convolutions increases as the end of maximum diameter is approached.

10. A blind unit comprising:

a head rail;

a plurality of blind members below the head rail;

a lower rail below the blind members, each blind member and the lower rail having a normally lowermost operative position;

a pair of spaced, parallel cords for suspending the lower rail below the head rail, said cords extending into the head rail, said lower rail being movable upwardly from said lowermost operative position thereof when an upward force is applied to the cords, said lower rail being operable to support a progressively greater or lesser number of blind members as the lower rail moves progressively upwardly or downwardly; and means for applying a variable, upwardly directed force to the cords with the force being substantially equivalent to the combined weights of the lower rail and the blind members supported on the lower rail when the lower rail is above its normal operative position, said applying means including a shaft rotatable relative to the head rail, a pair of spaced conical members on the shaft for rotation therewith, the conical members being aligned generally with respective cords, one of the cords being coupled with one of the conical members and the other cord being coupled to the other conical member, whereby the lower rail and the blind members can be raised or lowered by manually moving the lower rail upwardly or downwardly with a minimum of force applied to the lower rail.

11. A blind unit comprising:

a head rail having a bottom;

a plurality of blind members below the head rail;

a lower rail below the blind members, each blind member and the lower rail having a normally lowermost operative position;

cord means for suspending the lower rail below the head rail, said cord means extending into the head rail, said lower rail being movable upwardly from said lowermost operative position thereof when an upward force is applied to the cord means, said lower rail being operable to support a progressively greater or lesser number of blind members as the lower rail moves progressively upwardly or downwardly; and means for applying a variable, upwardly directed force to the cord means with the force being substantially equivalent to the combined weights of the lower rail and the blind members supported on the lower rail when the lower rail is above its normal operative position, said applying means including a carriage movable on the bottom, a constant force spring carried on the carriage, a shaft on the carriage, and a conical member coupled to and rotatable by the shaft, said shaft being coupled to the constant force spring for rotation thereby, said cord means being coupled to the conical member for raising and lower the blind members as a function of the rotation of the conical member by said spring relative to the carriage, whereby the lower rail and the blind member can be raised or lowered by manually moving the lower rail upwardly or downwardly with a minimum of force applied to the lower rail.

12. A blind unit as set forth in claim 11, wherein the carriage has a plurality of wheels in rolling engagement with the upper surface of the bottom of the head rail.

13. A blind unit as set forth in claim 11, wherein said carriage moves as a function of the movement of the cord means onto and off the conical member.

14. A blind unit as set forth in claim 11, wherein said cord means includes a pair of generally parallel cords, there being a conical member for each cord, respectively.

15. A blind unit as set forth in claim 14, wherein each conical member has a spiral groove in the outer surface thereof, the respective cord being movable into and out of the groove of the conical member, the cord being out of the groove and being at the maximum diameter end of the respective conical member when the lower rail is at its lowermost operative position, the cord being wrapped around the respective conical member and extending outwardly from the minimum diameter end of the conical member when the lower rail is at its highest position relative to the head rail.

16. A blind unit as set forth in claim 11, wherein the bottom of the head rail has slots for receiving the cord means, the slots extending longitudinally of the head rail.

17. A blind unit comprising:

a head rail;

a plurality of blind members below the head rail;

a lower rail below the blind members, each blind member and the lower rail having a normally lowermost operative position;

cord means for suspending the lower rail below the head rail, said cord means extending into the head rail, said lower rail being movable upwardly from said lowermost operative position thereof when an upward force is applied to the cord means, said lower rail being operable to support a progressively greater or lesser number of blind members as the lower rail moves progressively upwardly or downwardly; and means for applying a variable, upwardly directed force to the cord means with the force being substantially equivalent to the combined wights of the lower rail and the blind members supported on the lower rail when the lower rail is above its normal operative position, said applying means including a leaf spring extending upwardly form the head rail, said cord means including a cord having an upper end, and a weight element on the upper end of the cord, said weight element being movable along the spring for deflecting the spring and varying the spring force on the cord as a function of the position of the weight element along the spring, whereby the lower rail and the blind members can be raised or lowered by manually moving the lower rail upwardly or downwardly with a minimum of force applied to the lower rail.

18. A blind unit as set forth in claim 17, wherein the part of the cord above the blind members is coupled directly to the upper end of the spring.

19. A blind unit as set forth in claim 17, wherein a gear means is provided to couple the upper part of the cord to the upper end of the spring.

20. A blind unit comprising:

a head rail;

an indexing pin pivotally mounted on said head rail;

a plurality of blind members below the head rail;

a lower rail below the blind members, each blind member and the lower rail having a normally lowermost operative position;

cord means for suspending the lower rail below the head rail, said cord means extending into the head rail, said lower rail being movable upwardly from said lowermost operative position thereof when an upward force is applied to the cord means, said lower rail being operable to support a progressively greater or lesser number of blind members as the lower rail moves progressively upwardly or downwardly; and means for applying a variable, upwardly directed force to the cord means with the force being substantially equivalent to the combined weights of the lower rail and the blind members supported on the lower rail when the lower rail is above its normal operative position, said applying means including a rotatable conical member having a spiral groove, said indexing pin being operable to keep the cord means in the groove of said member, whereby the lower rail and the blind members can be raised or lowered by manually moving the lower rail upwardly or downwardly with a minimum of force applied to the lower rail.

21. A blind unit comprising:

a head rail;

a plurality of blind members below the head rail;

a lower rail below the blind members, each blind member and the lower rail having a normal lowermost operative position;

cord means for suspending the lower rail below the head rail, said cord means extending into the head rail, said lower rail being movable upwardly from said lowermost operative position thereof when an upward force is applied to the cord means, said lower rail being operable to support a progressively greater or lesser number of blind members as the lower rail moves progressively upwardly or downwardly; and means including a leaf spring means for applying a variable, upwardly directed force to the cord means with the force being substantially equivalent to the combined weights of the lower rail and the blind members supported on the lower rail when the lower rail is above its normal operative position, whereby the lower rail and the blind members can be raised or lowered by manually moving the lower rail upwardly or downwardly with a minimum of force applied to the lower rail.

22. A blind unit as set forth in claim 21, wherein said leaf spring means includes a leaf spring extending upwardly from the head rail, said cord means including a cord having an upper end, and a weight element on the upper end of the cord, said weight element being movable along the spring for deflecting the spring and varying the spring force on the cord as a function of the position of the weight element along the spring.

23. A blind unit as set forth in claim 22, wherein the part of the cord above the blind members is coupled directly to the upper end of the spring.

24. A blind unit as set forth in claim 22, wherein a gear means is provided to couple the upper part of the cord to the upper end of the spring.

* * * * *